US011679572B2

(12) United States Patent
Brisbin et al.

(10) Patent No.: US 11,679,572 B2
(45) Date of Patent: Jun. 20, 2023

(54) BALING ASSEMBLY

(71) Applicant: Sebright Products, Inc., Hopkins, MI (US)

(72) Inventors: William D. Brisbin, Hopkins, MI (US); Brent Sebright, Hopkins, MI (US)

(73) Assignee: Sebright Products, Inc., Hopkins, MI (US)

( * ) Notice: Subject to any disclaimer, the term of this patent is extended or adjusted under 35 U.S.C. 154(b) by 0 days.

(21) Appl. No.: 17/350,433

(22) Filed: Jun. 17, 2021

(65) Prior Publication Data

US 2022/0009188 A1 Jan. 13, 2022

Related U.S. Application Data

(60) Provisional application No. 62/705,670, filed on Jul. 9, 2020.

(51) Int. Cl.
*B30B 9/30* (2006.01)
*B65B 13/20* (2006.01)

(52) U.S. Cl.
CPC ..... *B30B 9/3003* (2013.01); *B30B 9/3014* (2013.01); *B65B 13/20* (2013.01)

(58) Field of Classification Search
CPC ..... B30B 9/30; B30B 9/3031; B30B 9/3003; B30B 9/3014; B30B 9/305; B30B 9/3053; B30B 9/306; B30B 9/3089; B30B 9/301; B30B 9/3078; B30B 9/3096; B65B 13/20; B65B 63/02; A01F 15/08
See application file for complete search history.

(56) References Cited

U.S. PATENT DOCUMENTS 5,353,698 A * 10/1994 Robbins ..... B30B 9/3003 100/255
5,566,610 A * 10/1996 Robinson ..... B30B 9/3003 100/98 R
7,237,477 B1 * 7/2007 Fox ..... B30B 9/3003 100/25
7,540,234 B1 * 6/2009 Fox ..... B30B 9/3032 100/215
10,493,714 B2 * 12/2019 Schwelling ..... B65G 65/23
2016/0023417 A1 * 1/2016 Hanson ..... B30B 9/3007 100/99

FOREIGN PATENT DOCUMENTS

CN 207206104 U * 4/2018 ..... B24B 27/00

OTHER PUBLICATIONS

English translation of CN 207206104U (4 pages) (Year: 2018).*

* cited by examiner

*Primary Examiner* — Jimmy T Nguyen
(74) *Attorney, Agent, or Firm* — McGarry Bair PC

(57) ABSTRACT

A baling assembly can include a housing defining an interior, an access panel coupled to the housing and providing selective access to the interior, a baling chamber within the housing, and a ram adjacent the baling chamber. The ram includes a movable wall and a driving mechanism operably coupled to the movable wall for compression of material within the baling chamber.

19 Claims, 10 Drawing Sheets

BALING ASSEMBLY

CROSS-REFERENCE TO RELATED APPLICATION(S)

This application claims the benefit of U.S. Provisional Patent Application No. 62/705,670, filed Jul. 9, 2020, which is incorporated herein by reference in its entirety.

TECHNICAL FIELD

The disclosure generally relates to balers and baling assemblies, and more specifically to accessibility or inspection mechanisms for baling assemblies.

BACKGROUND

Balers have been used for years by farmers to efficiently pack, handle, and transport straw and hay. An increase in demand to efficiently pack, handle, and transport materials other than straw and hay brought balers into the industrial arena. Balers in the industrial arena commonly incorporate a compactor. Balers typically compress and bind cardboard, plastic, aluminum, other recyclables, or other waste material.

BRIEF DESCRIPTION

In one aspect, the disclosure relates to a baling assembly. The baling assembly includes a housing defining an interior, an access panel coupled to the housing and providing selective access to the interior, wherein a portion of the interior is viewable through the access panel from outside the housing, a light source located within the housing and configured to illuminate the interior, a baling chamber within the housing, and a ram adjacent the baling chamber, the ram comprising a movable wall and a driving mechanism operably coupled to the movable wall for compression of material within the baling chamber.

In another aspect, the disclosure relates to a baling assembly. The baling assembly includes a housing defining an interior, a baling chamber within the housing, a gathering ram adjacent the baling chamber and extending from the baling chamber along a first direction, the gathering ram comprising a first movable wall and a first driving mechanism operably coupled to the first movable wall for compression of material within the baling chamber, an ejection ram adjacent the baling chamber and extending from the baling chamber along a second direction, the ejection ram comprising a second movable wall and a second driving mechanism operably coupled to the second movable wall for ejection of compressed material from the baling chamber, a first access panel located at a distal end of the gathering ram and a second access panel located at a distal end of the ejection ram, wherein a portion of the interior is viewable from outside the housing through the first access panel and through the second access panel, a first light source within the housing adjacent the first access panel, and a second light source within the housing adjacent the second access panel.

DESCRIPTION

Figure 1:
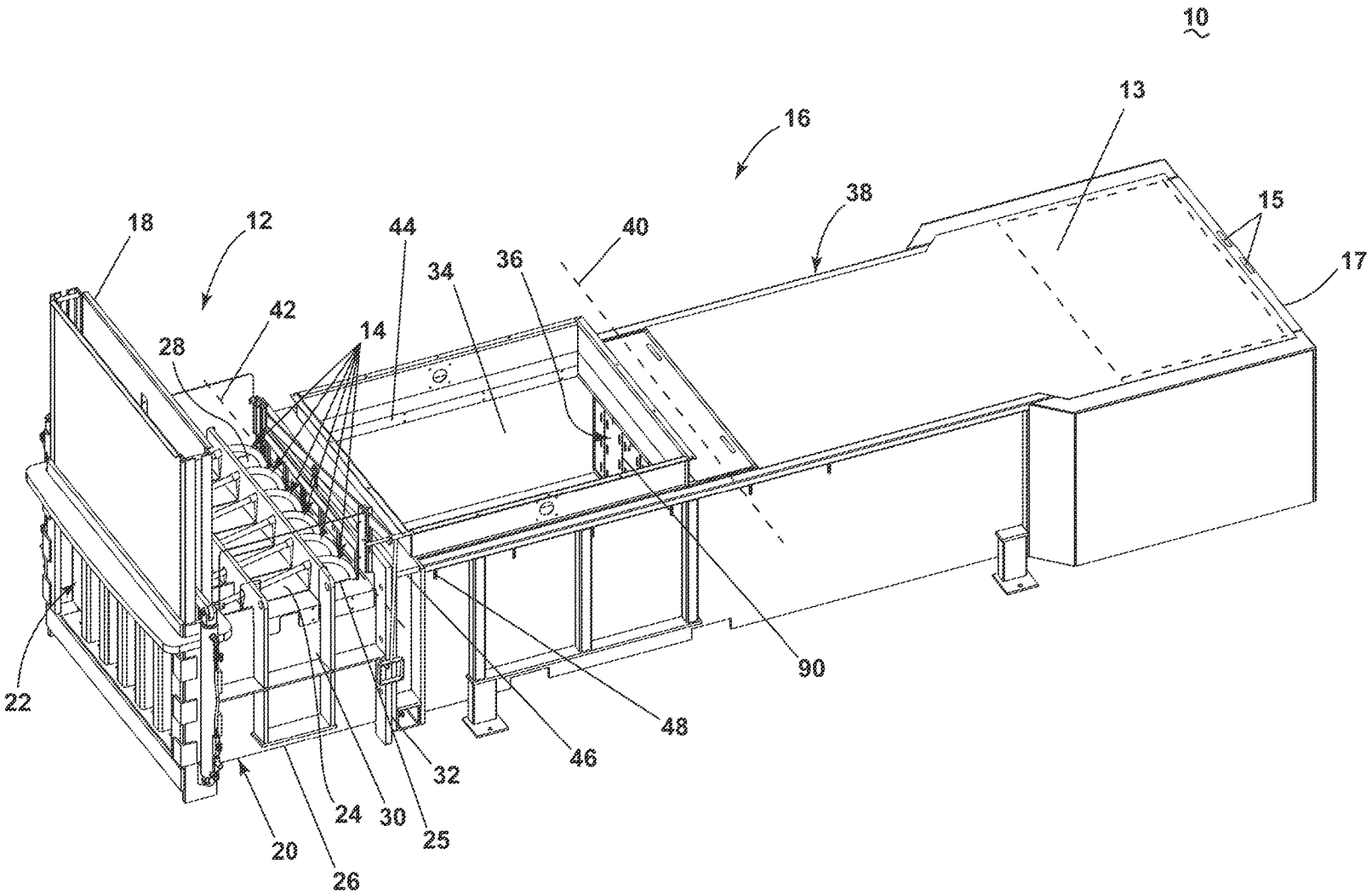
FIG. 1 is an isometric view of an exemplary baling assembly in accordance with various aspects described herein.

Aspects of the disclosure generally relate to balers or baling assemblies for compressing, containing, or securing a variety of materials. Balers typically include a hopper for loading the material to be compressed. A compacting mechanism can then compress the material within a baling chamber. Additionally or alternatively, material to be baled can be loaded directly into the baling chamber. Bale ties, netting, or the like can be applied to the compressed material for securing or containing the material in its compressed state.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, mounted, connected, fixed, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 illustrates one exemplary baling assembly 10 in accordance with various aspects described herein. The baling assembly 10 includes a housing 12, a set of baling guides 14, a ram chamber 16 within the housing 12, and a baling chamber 20 within the housing 12. The baling chamber 20 can include a movable front wall 22, a top wall 24, a bottom wall 26, opposing side walls 28, 30, and a back plane 32. The top wall 24 can include a top wire inlet 25. The top wire inlet 25 can be, by way of non-limiting example, in the shape of a slot that can allow a bale tie to pass through the top wall 24 into the baling chamber 20.

One or more access panels 13 can be provided in the housing 12 of the baling assembly 10. In one example, the access panel 13 can be removably mounted to the housing 12 and providing user access to the interior of the housing 12, such as for visual inspection, hands-on maintenance, insertion of tools, or the like, or combinations thereof. In the example shown, one access panel 13 is illustrated along the housing 12 proximate the ram chamber 16 opposite the baling chamber 20. Any number or positioning of access panels 13 can be utilized. The access panel 13 can be formed of any suitable material including, but not limited to, steel, aluminum, polycarbonate, acrylic, glass, or the like, or combinations thereof. It is contemplated that the access panel 13 can be formed of a transparent or translucent material such that interior portions of the baling assembly 10 can be viewed from the exterior of the baling assembly 10 during operation. In one example, the access panel 13 can be removably mounted to the housing 12 such as by a latch-and-catch mechanism, bolts or screws, or the like. Additionally or alternatively, the access panel 13 can be a non-removable portion of the housing 12 and formed of a transparent or translucent material providing for visual inspection of components therein. It is contemplated that any portion of the housing 12 can be formed of a transparent or translucent material, including a removable cover, a non-removable sidewall, or the like.

In addition, one or more light sources 15 can be provided in the baling assembly 10 for illuminating portions of the interior of the baling assembly 10. The light source 15 can be coupled, secured, mounted, or the like to any suitable portion of the housing 12. In non-limiting examples, the light source 15 can be coupled to an upper surface, a lower surface, a sidewall, or a frame member of the housing 12. In the example shown, two elongated light sources 15 are illustrated as being coupled to a back wall 17 of the housing 12 though any number of light sources 15 can be utilized, including only one. The light source 15 can include any suitable type of light source including one or multiple light-emitting diodes (LED), fluorescent bulbs, incandescent bulbs, or the like. Furthermore, the light source 15 can have any suitable form, such as a single LED, a strip of LEDs, an elongated bulb, or the like, or combinations thereof. The light source 15 can be selectively operated, such as via a switch (not shown) on the housing 12 or on a remote device. Additionally or alternatively, the light source 15 can continuously illuminate the interior of the baling assembly 10 during operation.

The front wall 22 of the housing 12 is illustrated in the example of FIG. 1 as a gate-like structure, though this need not be the case. When the front wall 22 is in a "down" or "closed" position as illustrated, the front wall 22 defines a portion of the baling chamber 20. The front wall 22 can also be lifted into an "up" or "open" position (not shown) and is received within a front wall receiving chamber 18.

The ram chamber 16 can be positioned within the housing 12 at the back plane 32 of the baling chamber 20. It is contemplated that at least one wall 22, 24, 26, 28, 30 or 32 of the baling chamber 20 couples to the ram chamber 16. It is further contemplated that the ram chamber 16 can couple to the baling chamber 20 at one or more of the walls or planes 22, 24, 26, 28, 30 or 32.

In the example of FIG. 1, the baling assembly 10 is illustrated as including a hopper 34 for receiving material to be baled. It is also contemplated that material to be baled can be loaded into the hopper 34 via a conveyor system, or loaded directly into the baling chamber 20 without use of the hopper 34, or the like, or combinations thereof.

The ram chamber 16 can include a ram wall 36 coupled to a ram wall driving mechanism 38. The ram wall driving mechanism 38 can be, but is not limited to, a hydraulic cylinder that can move the ram wall 36 from a first position 40 to a second position 42 to compress material to be baled into the baling chamber 20. By way of non-limiting example, when moving the ram wall 36 from the first position 40 to the second position 42, the ram wall 36 can move past the second position 42 toward the front wall 22 of the baling chamber 20 before returning to the second position 42. The ram wall 36 can move several times back and forth to various positions between the first position 40 and the front wall 22 before finishing a cycle in the second position 42, where the material to be baled is compressed within the baling chamber 20 between the ram chamber 16 and the front wall 22. The first position 40 and second position 42 are shown by way of non-limiting example in example of FIG. 1, and it will be understood that the first position 40 and second position 42 can be located at any suitable location within the ram chamber 16. One or more sensors can be used to ensure the ram wall 36 is properly located in the first or second position 40, 42. By way of non-limiting example, the one or more sensors can be an optical sensor, a photoelectric sensor, an ultrasonic sensor, a pressure sensor, a global positioning system (GPS), or a field sensor.

In one non-limiting example, a back wire slot 90 can be included in the ram wall 36. The back wire slot 90 can be, by way of non-limiting example, in the shape of a slot that can allow a bale tie to exit the ram wall 36 and enter the baling chamber 20.

In one non-limiting example, the exemplary baling assembly 10 can further include an adjustable ram guide. The adjustable ram guide can include adjustable hold-down bars 44 and an adjustable frame shear 46. The adjustable hold-down bars 44 can be loosened by bolts 48. Once the adjustable hold-down bars 44 are adjusted to a new position, the bolts 48 can be tightened to maintain the adjusted position. Similarly, the adjustable frame shear 46 includes bolts (not shown) that can be loosened allowing for the adjustment of the position of the adjustable frame shear 46. Optionally, the adjusted position of the adjustable hold-down bars 44 or the adjustable frame shear 46 can be further supported by the addition of shims.

Figure 2:
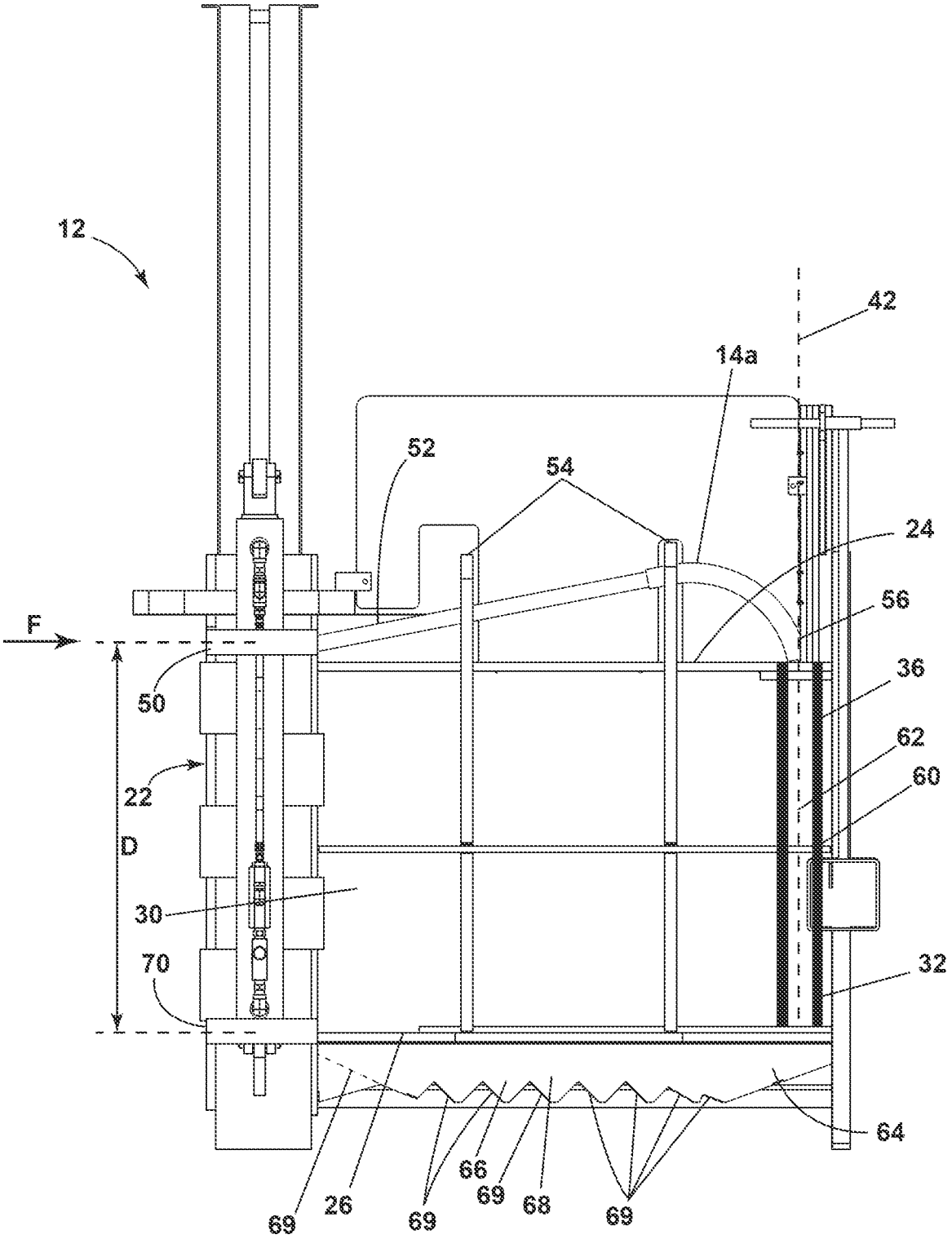
FIG. 2 is a schematic cross section of a portion of the baling assembly of FIG. 1.

FIG. 2 is a schematic cross section of the housing 12 of the baling assembly 10 when the ram wall 36 is in the second position 42, where material to be baled is compressed within the baling chamber 20. A baling guide 14*a* is representative of the set of baling guides 14. It is contemplated that each baling guide in the set of the baling guides 14 is similar to the baling guide 14*a*. The baling guide 14*a* includes an entrance 50, a top portion 52, a first corner 56, a back portion 60, a second corner 64, a bottom portion 66, and an exit 70. It is contemplated that any combination of tubing, conduit, connecting portions, curved or straight portions, angled portions, spacing, grooves, or the like can be utilized in the set of baling guides 14.

The entrance 50 for receiving a bale tie is illustrated, by a non-limiting example, as an opening in the front wall 22 of the baling chamber 20 wherein the bale tie is fed into the entrance 50. The entrance 50 can couple to a top portion 52 of the baling guide 14*a*. As illustrated by non-limiting example, the top portion 52 of the baling guide 14*a* can be a tube or conduit. Optionally, the tube or conduit can include one or more gaps, grooves, or openings. Additionally or alternatively, the top portion 52 of the baling guide 14*a* can be a groove or angled surface used to guide the bale tie.

The top portion 52 can be supported by at least a portion of the top wall 24 of the baling chamber 20 by top mounts 54. The first corner 56 connects the top portion 52 of the baling guide 14*a* to the back portion 60. The back portion 60 of the baling guide 14*a*, by way of non-limiting example, is illustrated as through-holes 62 in the ram wall 36 that can receive the bale tie. A second corner 64 can couple the back portion 60 of the baling guide 14*a* to the bottom portion 66 of the baling guide 14*a*.

Optionally, a wire guide 68 can be provided within the baling chamber 20. In the illustrated example, the wire guide 68 is located below the bottom wall 26 of the baling chamber 20 and define the bottom portion 66 of the baling guide 14*a*. The wire guide 68 can include one or more gaps, grooves, or openings. In the example shown, the wire guide 68 of the bottom portion 66 of the baling guide 14*a* includes a series of angled surfaces 69 that guide, urge, or otherwise direct a bale tie toward the exit 70 on the front wall 22. The exit 70 is illustrated as spaced a distance D from the entrance 50. The distance D between the entrance 50 and the exit 70 can be any suitable non-zero distance, including between 0 and 20 cm, or 100 cm or more, in non-limiting examples.

Figure 3:
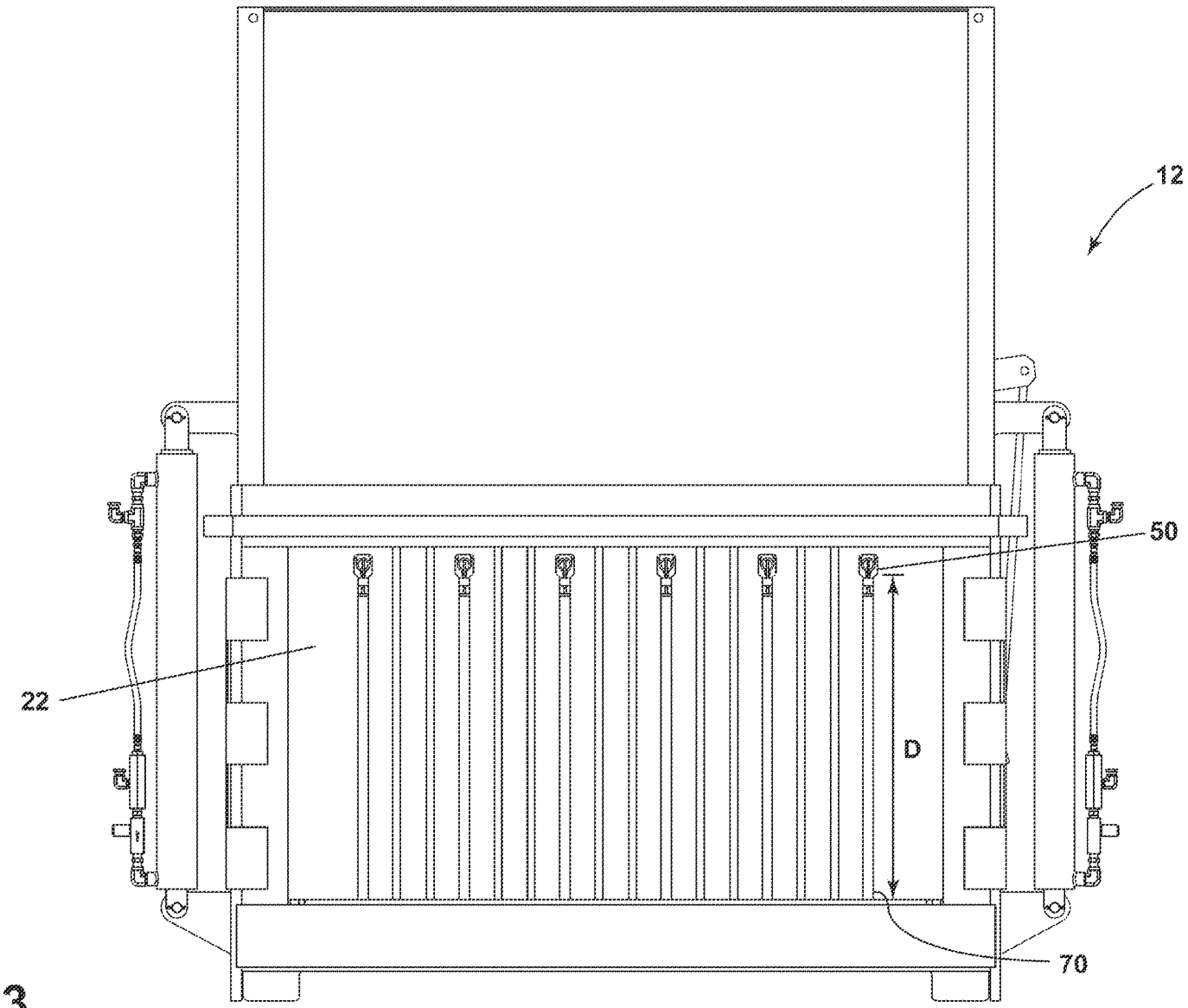
FIG. 3 is a front view of a housing of the baling assembly of FIG. 1 and having an access panel and lighting assembly in accordance with various aspects described herein.

FIG. 3 is a front perspective view of the housing 12 of the baling assembly 10. FIG. 3 further illustrates the exit 70 spaced the distance D from the entrance 50 on the front wall 22. It is contemplated that the entrance 50 and the exit 70 that is a distance D from the entrance 50, can be on any one wall 22, 24, 26, 28, 30, or 32 of the baling chamber 20, provided that the entrance 50 and the exit 70 are on the same wall.

Figure 4:
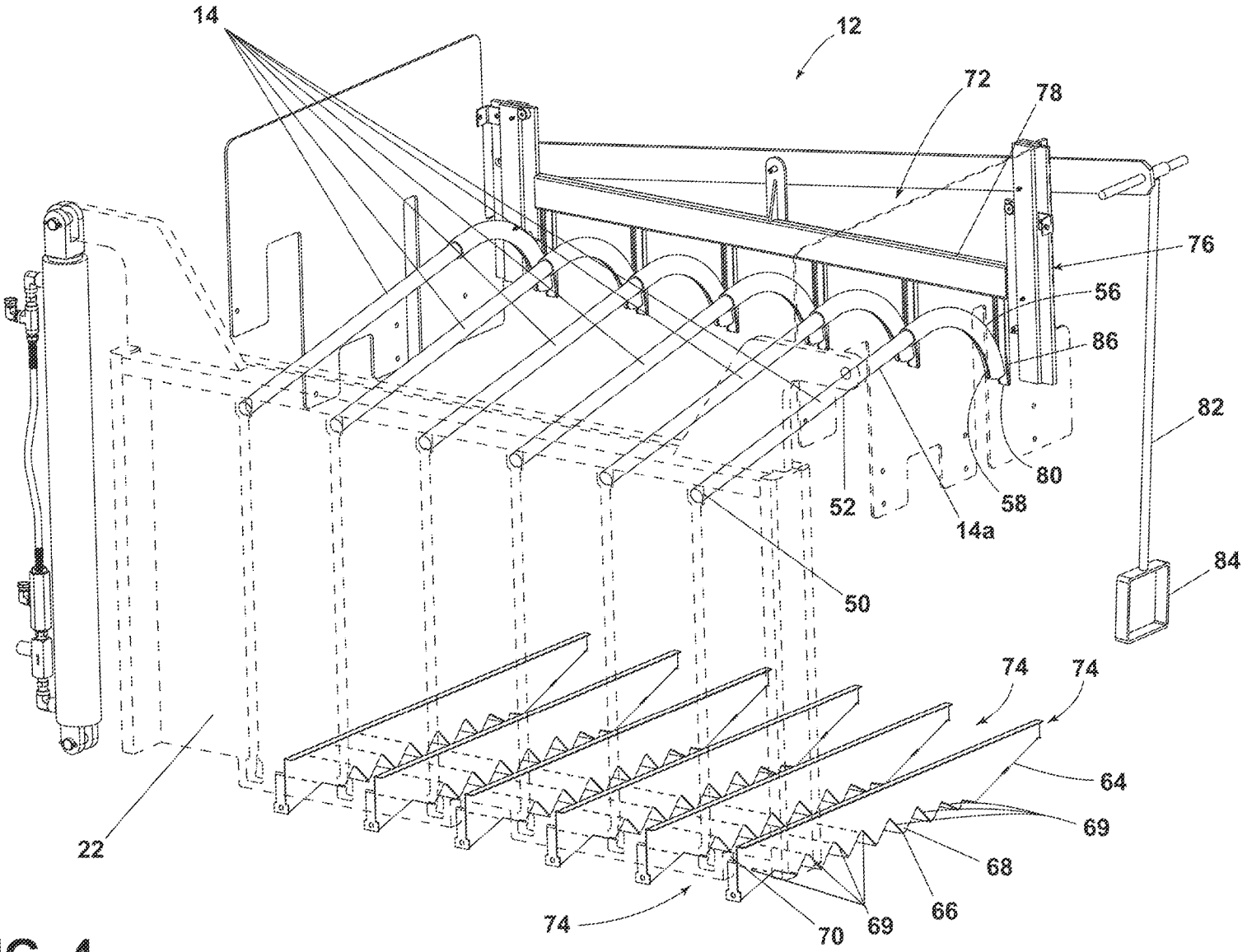
FIG. 4 is an isometric view of a portion of a baling guide that can be utilized in the baling assembly of FIG. 1.

FIG. 4 is a perspective view of the housing 12 with the top wall 24, bottom wall 26, and opposing side walls 28, 30 removed. The ram wall 36 is in the first position 40 (FIG. 1) and is therefore not illustrated in this image.

A top wire slot 58 can be included in the top portion 52 of the baling guide 14*a*. The top wire slot 58 can have dimensions such that the bale tie cannot pass through the top wire slot 58 until the bale tie is guided through the top portion 52 of the baling guide 14*a*. The top wire slot 58 can correspond to the top wire inlet 25 (FIG. 1) such that when the bale tie exits the top portion 52, it can enter the baling chamber 20 via the top wire inlet 25 (FIG. 1).

The baling assembly 10 can include a cleaning system 72. The cleaning system 72 can include a compressed air flow 74 or a piercer 76, or both. The compressed air flow 74 can be provided by a pneumatic source (not shown) and is illustrated by non-limiting examples in FIG. 4 as arrows that indicate a possible direction for the flow of compressed air. It is contemplated that the compressed air flow 74 can be used to clean or clear one or more portions of the set of baling guides 14.

The piercer 76 can include a support beam 78, at least one tine 80, and an actuating mechanism 82. The support beam 78 couples to at least one tine 80 and an actuating mechanism 82. As illustrated, by way of non-limiting example, the actuating mechanism 82 can be activated by a foot pedal 84. Further it is contemplated that the actuating mechanism 82 can be, by way of non-limiting example, activated by a controller based on input from a sensor.

The at least one tine 80 is illustrated, by way of non-limiting example, to have a channel portion 86. The channel portion 86 can be a component of the first corner 56 to assist in the transition from the top portion 52 of the baling guide 14*a* to the back portion 60. It is also contemplated that the at least one tine 80, when activated, pierces the through-holes 62 of the ram wall 36 that define the back portion 60 of the baling guide 14*a*. It is further contemplated that the piercer 76 can be configured to clean or clear one or more portions of the set of bale guides 14.

With reference to FIGS. 1-4, during operation of the baling assembly 10, material can be inserted into the hopper 34 and compressed by the ram wall 36. After compression, a user can insert a bale tie through the entrance 50 wherein one end of the bale tie passes through the baling guides 14 and ram wall 36 and along the bottom wall 26, wherein the angled surfaces 69 guide, urge, or otherwise direct the bale tie end toward the exit 70. In this manner, a user can insert a bale tie through the entrance 50, around the compressed material, and through the exit 70, wherein opposing ends of the bale tie can be coupled to one another around the compressed material to secure the bale.

Furthermore, the transparent access panel 13 can provide for visual inspection of internal components of the baling assembly 10 including the ram chamber 16, baling chamber 20, or the like. The light source 15 can illuminate portions of the interior of the baling assembly 10, including portions adjacent the transparent access panel 13, to provide for improved visual inspection of the baling assembly 10.

Figure 5:
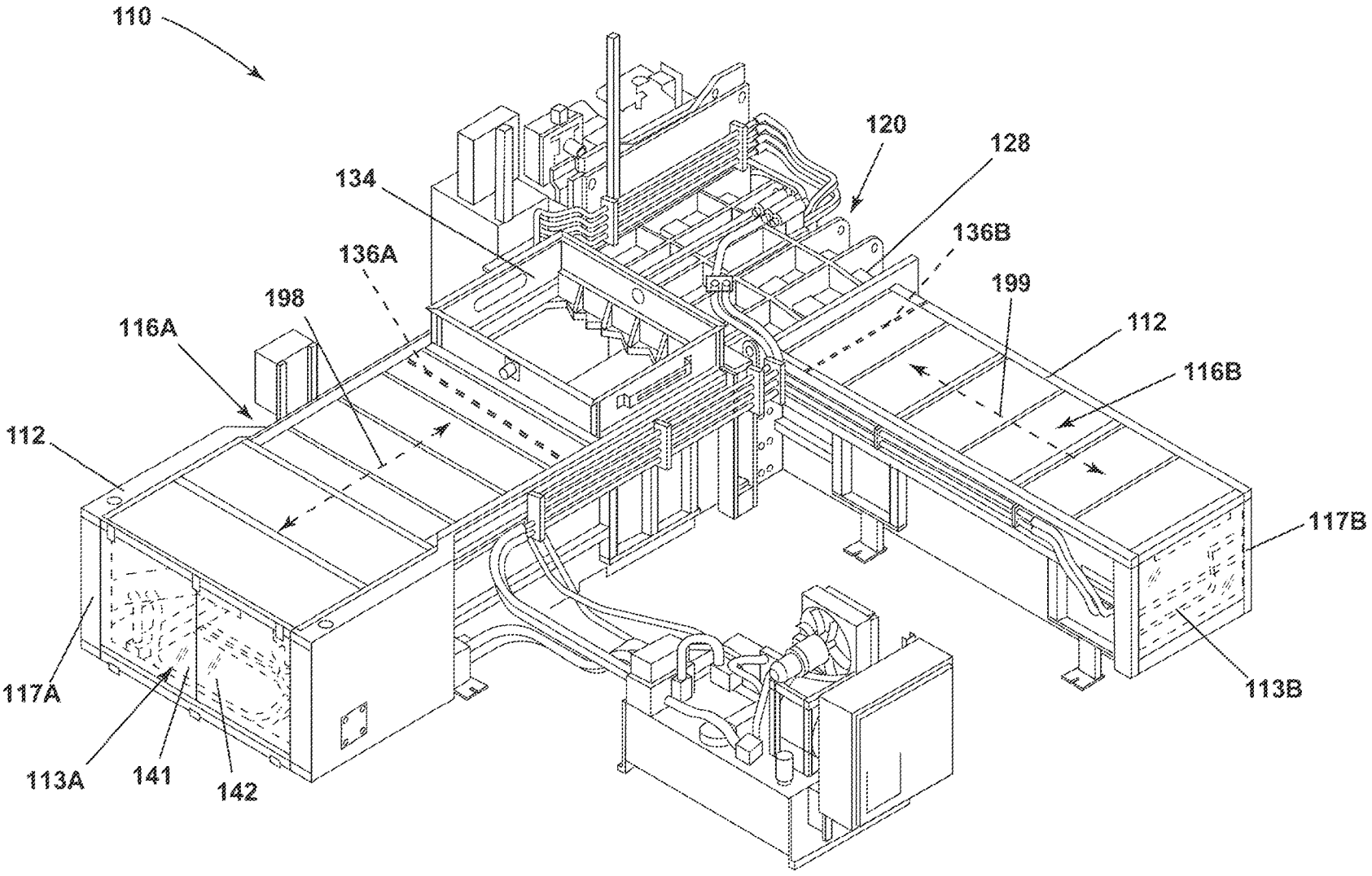
FIG. 5 is a front isometric view of another baling assembly in accordance with various aspects described herein.

Referring now to FIG. 5, another baling assembly 110 is illustrated in accordance with various aspects described herein. The baling assembly 110 is similar to the baling assembly 10. Therefore, like parts will be described with like numerals increased by 100, with it being understood that the description of the like parts of the baling assembly 10 applies to the baling assembly 110, except where noted.

The baling assembly 110 includes a housing 112, a baling chamber 120, and a hopper 134. One difference is that the baling assembly 110 includes multiple ram chambers in the form of a gathering ram chamber 116A extending in a first direction 198 and an ejection ram chamber 116B extending in a second direction 199. In the example shown, the second direction 199 is perpendicular to the first direction 198 though this need not be the case. The gathering ram chamber 116A includes a first distal end 117A (or "first end 117A") opposite the baling chamber 120. The ejection ram chamber 116B includes a second distal end 117B (or "second end 117B) opposite the baling chamber 120 as shown.

The gathering ram chamber 116A includes a gathering ram wall 136A movable along the first direction 198 and configured to compress material from the hopper 134 against a side wall 128 of the baling chamber 120, where baling ties, netting, or other suitable components can be applied to the compressed material to secure the bale within the housing 112. The ejection ram chamber 116B includes an ejection ram wall 136B movable along the second direction 199 and configured to direct the compressed bale of material out of the housing 112.

One or more access panels can be provided in the baling assembly 110. In the example shown, a first access panel 113A is provided at the first end 117A and a second access panel 113B is provided at the second end 117B. The access panels 113A, 113B can at least partially enclose the interior of the housing 112 and be formed of a transparent or translucent material, such as glass, plexiglass, or polycarbonate in a non-limiting example. The access panels 113A, 113B can provide for at least visual inspection of internal components within the baling assembly 110, including of the gathering ram 116A or the ejection ram 116B.

Figure 6:
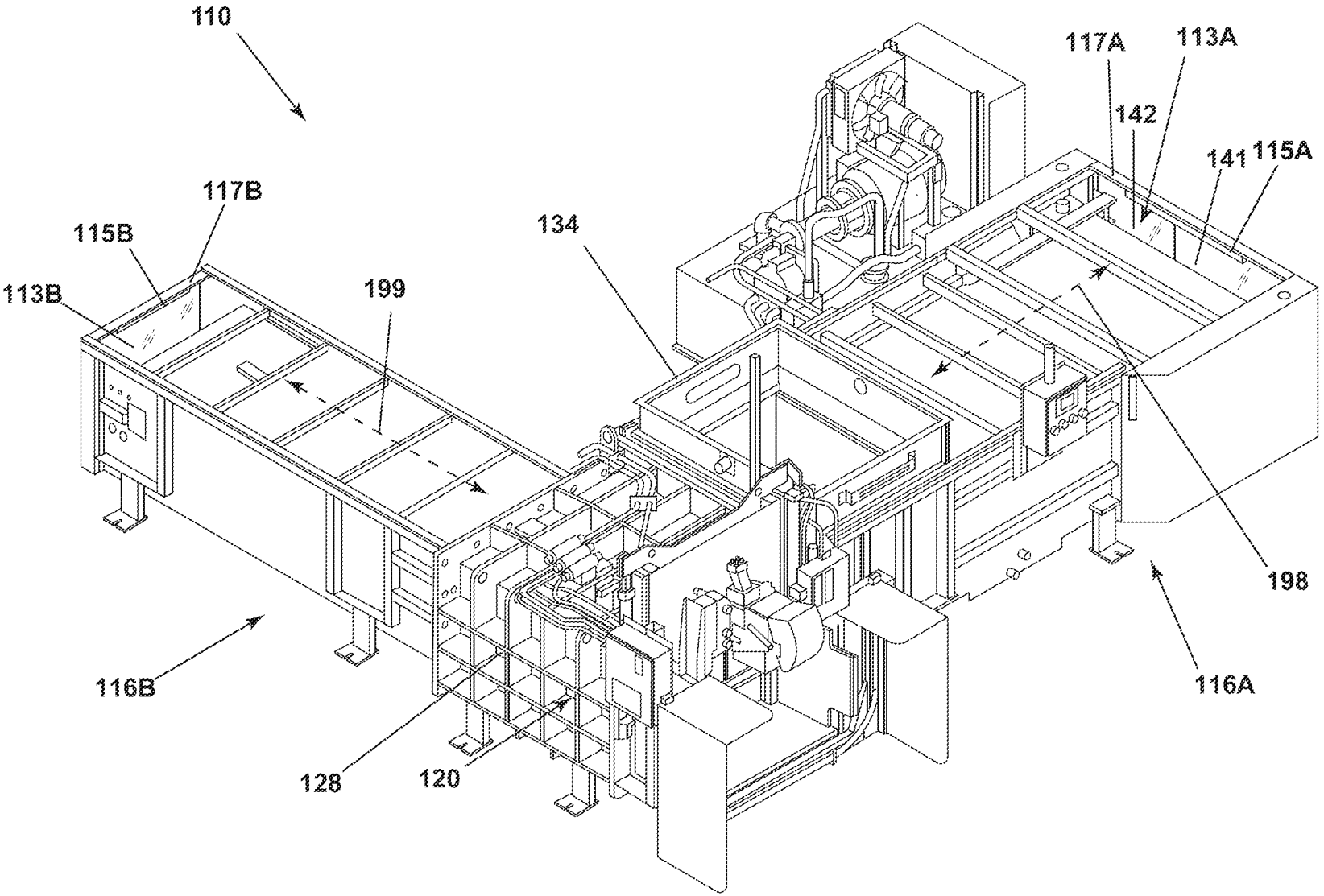
FIG. 6 is a rear isometric view of the baling assembly of FIG. 5 illustrating an access panel and a lighting assembly.

Turning to FIG. 6, a rear isometric view of the baling assembly 110 is illustrated with top wall portions of the housing 112 removed for clarity. It is further contemplated that at least one light source can be provided. In the example shown, a first light source 115A is provided along a portion of the housing 112 adjacent the first end 117A, and a second light source 115B is provided along a portion of the housing 112 adjacent the second end 117B. It is contemplated that the first and second light sources 115A, 115B can be in the form of an elongated LED, though this need not be the case. In this manner, the interior of the gathering ram chamber 116A and ejection ram chamber 116 can be viewed from outside the baling assembly 110 without need of removing or uninstalling panels from the housing 112.

Figure 7:
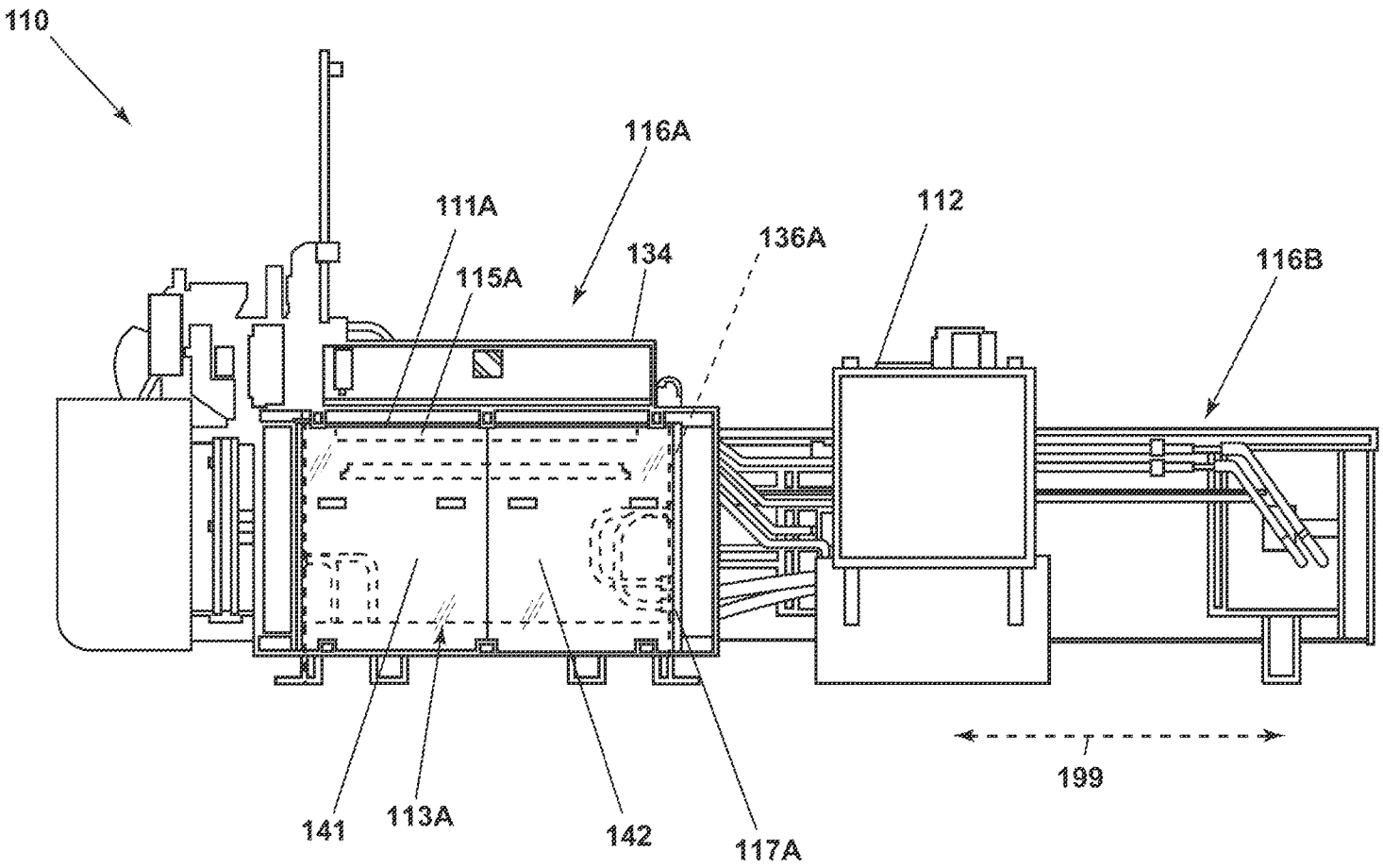
FIG. 7 is a side view of the baling assembly of FIG. 5 illustrating a first transparent panel and lighting assembly in accordance with various aspects described herein.

FIG. 7 illustrates a side view of the baling assembly 110 along the first direction 198. In this view, the gathering ram wall 136A and other portions of the gathering ram chamber 116A are visible through the transparent or translucent first access panel 113A. It is further contemplated that the first access panel 113A can include a first panel 141 and a second panel 142. Either or both of the first panel 142 and the second panel 142 can be independently removable from the housing 112. Additionally or alternatively, the first panel 141 and the second panel 142 can be rotatably coupled to the housing 112, such as a rotatable door. The first panel 141 and the second panel 142 of the first access panel 113A can be the same size or have different sizes, and can also have any suitable size, including 120 cm tall by 120 cm wide, or 42 inches tall by 35 inches wide, in non-limiting examples.

The first light source 115A can be mounted adjacent the first access panel 113A within the housing 112, and is illustrated along a top frame member 111A though this need not be the case. The first light source 115A can be secured, mounted, or otherwise coupled at any suitable location within the housing 112, including along a top wall, bottom wall, side wall, frame member, or the like. In one non-limiting example, the first light source 115A can be in the form of a ring of LEDs placed along each of a top wall, bottom wall, and both sidewalls, thereby illuminating an annulus within the gathering ram 116A. In another non-limiting example, the first light source 115A can include multiple LEDs each illuminating along a different angle to provide a broad light cast within the housing 112.

Figure 8:
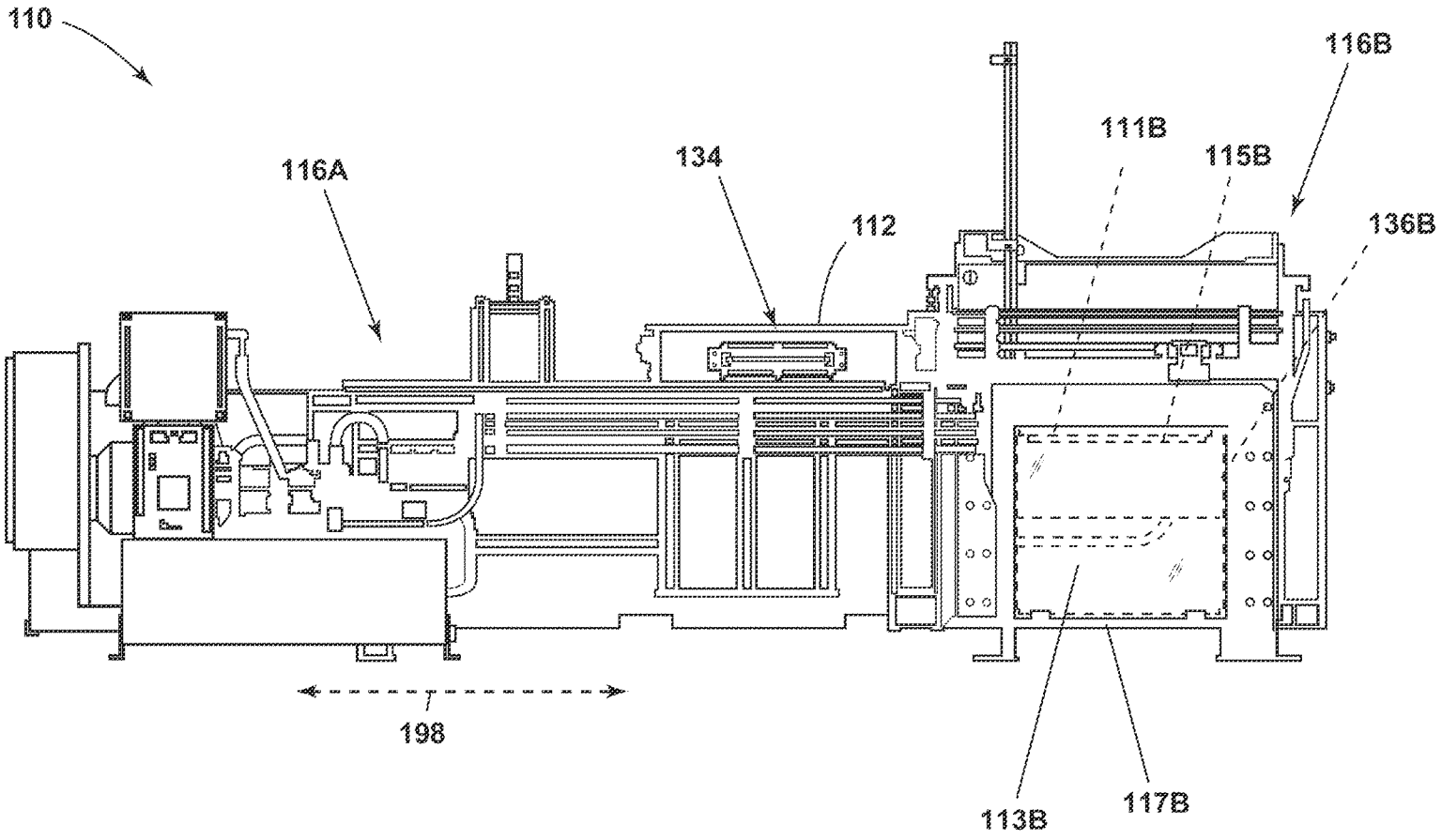
FIG. 8 is another side view of the baling assembly of FIG. 5 illustrating a second transparent panel and lighting assembly in accordance with various aspects described herein.

FIG. 8 illustrates another side view of the baling assembly 110 along the second direction 199. In this view, the ejection ram wall 136B is visible through the transparent or translucent second access panel 113B. The second access panel 113B is illustrated as a single-piece access panel though this need not be the case. The second access panel 113B can have any suitable size, including 100 cm tall by 100 cm wide, or 40 inches tall by 36 inches wide, in non-limiting examples. In another non-limiting example, the second access panel 113B can be rotatably coupled to the housing 112, such as a rotatable door providing access to the interior of the baling assembly 110. The second light source 115B can be mounted adjacent the second access panel 113B within the housing 112, and is illustrated along a top frame member 111B as shown. The second light source 115B can be secured, mounted, or otherwise coupled to any suitable location within the housing 112, including along a top wall, bottom wall, side wall, frame member, or the like, including in a manner similar to the first light source 115A.

Figure 9:
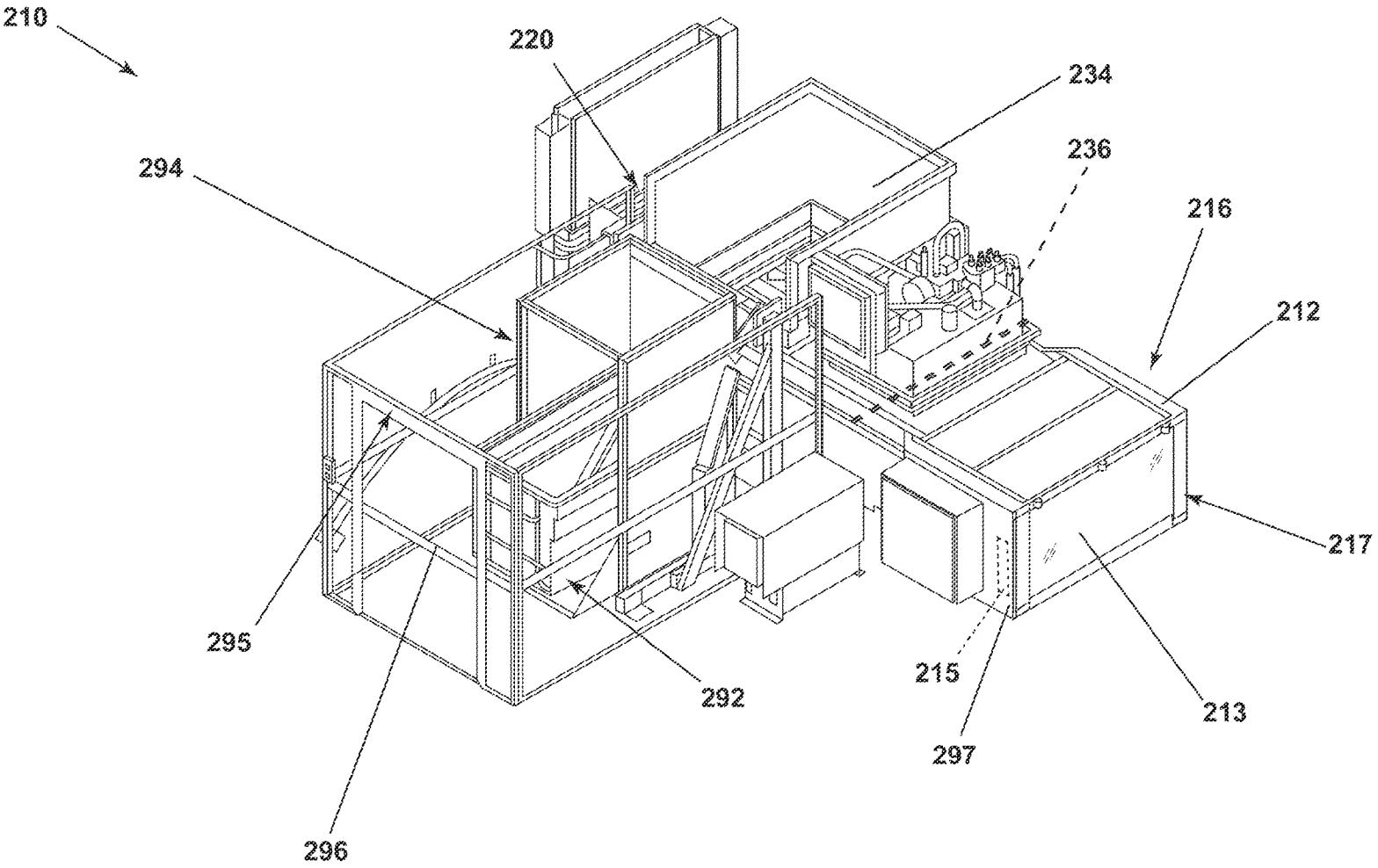
FIG. 9 is an isometric view of another baling assembly in accordance with various aspects described herein.

Referring now to FIG. 9, another baling assembly 210 is illustrated in accordance with various aspects described herein. The baling assembly 210 is similar to the baling assemblies 10, 110. Therefore, like parts will be identified with like numerals further increased by 100, with it being understood that the description of the like parts of the baling assembly 10, 110 applies to the baling assembly 210, except where noted.

The baling assembly 210 includes a housing 212, a ram chamber 216, a baling chamber 220, and a hopper 234. A movable ram wall 236 is provided within the ram chamber 216. One difference is that the baling assembly 210 is configured to load material into the hopper 234 via a storage container 292. The storage container 292 can be in the form of a dumpster, cart, or the like, and can be removable from the baling assembly for re-loading. In one example, the storage container 292 can be in the form of a flat-bottomed dumpster and movable by a vehicle such as a skid steer, forklift, or the like. In another example, the storage container 292 can be in the form of a wheeled cart wherein a user can manually move the storage container into place within the baling assembly 210.

The baling assembly 210 can further include a dumping mechanism 294 configured to move the storage container 292 into place above the hopper 234, such that material to be compressed can be transferred from the storage container 292 through the hopper 234 and into the baling chamber 220. In one non-limiting example, material to be compressed can fall by gravity into the hopper 234. In this manner, the dumping mechanism 294 can be configured to lift the storage container 292 and transfer material from the storage container 292 into the hopper 234. The ram 216 can compress the material within the baling chamber 220, and baling ties can be applied to the compressed material to form bales therein.

The baling assembly 210 can further include a cage 295 having a gate opening 296 to provide for insertion or removal of the storage container 292 to or from the dumping mechanism 294. Optionally, the gate opening 296 can be lockable to prevent user access to moving portions of the dumping mechanism 294 during operation of the baling assembly 210.

One or more access panels can be provided in the baling assembly 210. In the example shown, an access panel 213 is provided at one end 217 of the housing 212 proximate the ram 216. The access panel 213 can at least partially enclose the interior of the housing 212 and be formed of a transparent or translucent material, such as polycarbonate or acrylic in non-limiting examples. Optionally, a light source 215 can also be provided within the housing 212. For example, the light source 215 can be mounted to a sidewall 297 of the housing 212 proximate the end 217.

Figure 10:
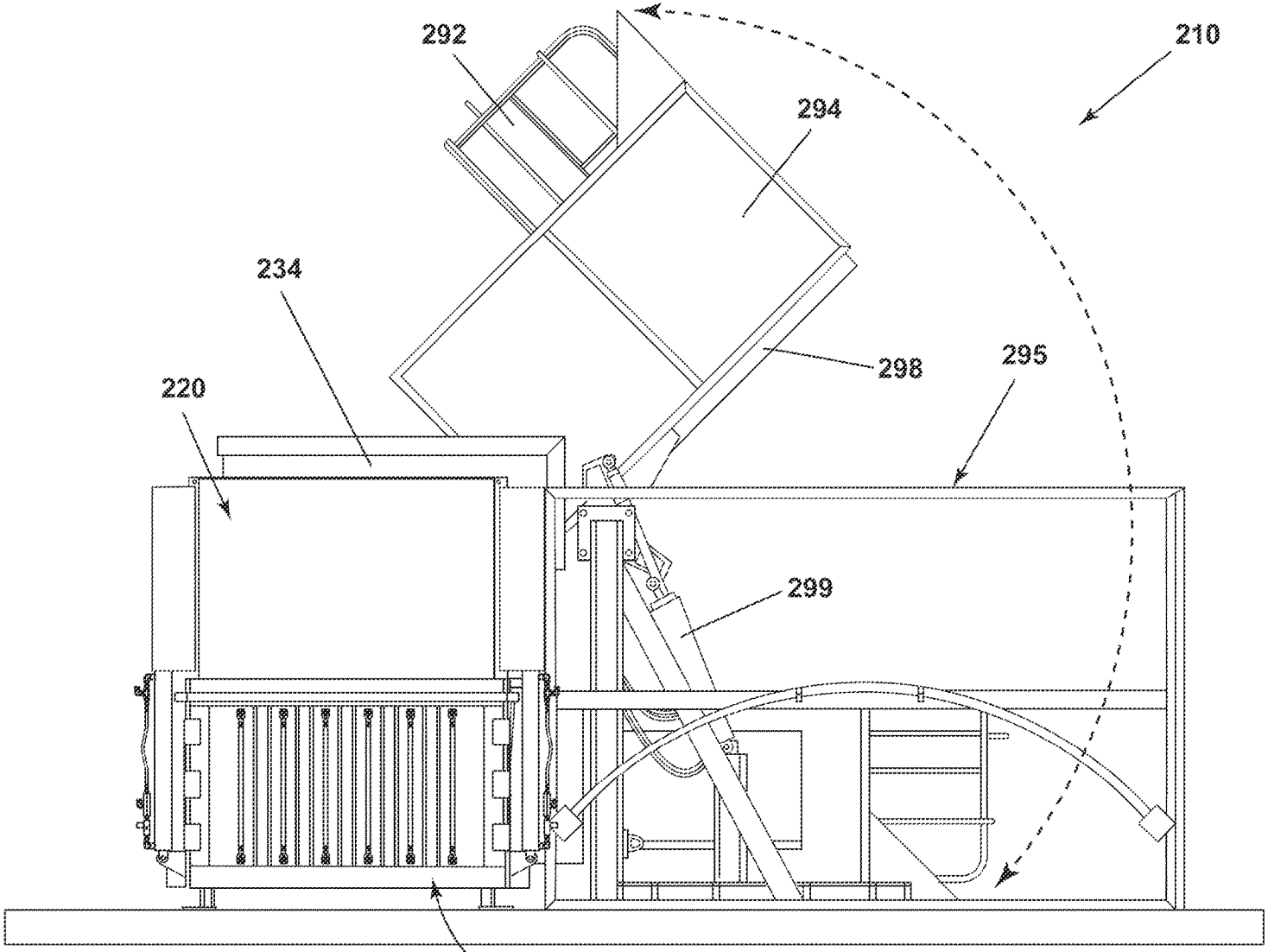
FIG. 10 is a schematic side view of the baling assembly of FIG. 9 in an operating position.

FIG. 10 illustrates the baling assembly 210 in one operating position. The dumping mechanism 294 can include a movable lifting surface 298, such as a platform or forked lifter, as well as a drive mechanism 299, such as a hydraulic cylinder, operably coupled to the lifting surface 298. In this manner the dumping mechanism 294 can rotate and lift the storage container 292 above the hopper 234 (illustrated with arrows in FIG. 10). Material within the storage container 292 can be dumped or fall into the hopper 234 and baling chamber 220 as shown. It is contemplated that the gate opening 296 can be locked while the baling assembly 210 is in the operating position shown.

Aspects of the disclosure provide for a variety of benefits, including the ability to visually inspect material before, during, or after compression into bales within the baling assembly. The use of transparent or translucent access panels can provide for ongoing inspection of internal components of the baling assembly. The access panels can optionally be made as removable components from the housing, providing for improved serviceability and operation of the baling assembly. Furthermore, the use of internal illumination via light sources within the housing can further improve inspection, safety, and serviceability of the bailing assembly, including during operation.

To the extent not already described, the different features and structures of the present disclosure can be used in combination with each other as desired. That one feature may not be illustrated in all the embodiments and is not meant to be construed that it cannot be, but is done for brevity of description. Thus, the various features of the different embodiments can be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A baling assembly, comprising:

a housing defining an interior;

a transparent access panel coupled to the housing and providing selective access to the interior, wherein a portion of the interior is viewable through the transparent access panel from outside the housing;

a light source located within the housing and configured to illuminate at least the portion of the interior;

a baling chamber within the housing; and a ram chamber within the housing adjacent the baling chamber, the ram chamber comprising a movable wall and a driving mechanism operably coupled to the movable wall for compression of material within the baling chamber; wherein the transparent access panel is provided at an end portion of the ram chamber opposite the baling chamber.

2. The baling assembly of claim 1, wherein the transparent access panel comprises one of glass, acrylic, or a polycarbonate material.

3. The baling assembly of claim 1, wherein the transparent access panel is removably mounted to the housing.

4. The baling assembly of claim 1, wherein the light source comprises at least one of a light-emitting diode, a fluorescent bulb, or an incandescent bulb.

5. The baling assembly of claim 1, wherein the transparent access panel is provided at a distal end of the ram chamber opposite the baling chamber.

6. The baling assembly of claim 1, further comprising an ejection ram chamber within the housing adjacent the baling chamber and comprising an ejection ram wall configured to eject compressed material out of the baling chamber.

7. The baling assembly of claim 6, further comprising a second transparent access panel positioned at a distal end of the ejection ram chamber opposite the baling chamber, wherein a portion of the interior is viewable through the second transparent access panel.

8. The baling assembly of claim 7, further comprising a second light source located within the ejection ram chamber and configured to illuminate portions of the ejection ram chamber.

9. The baling assembly of claim 1, further comprising a second transparent access panel, with at least one of the transparent access panel or the second transparent access panel forming a rotatable door.

10. The baling assembly of claim 1, further comprising a hopper configured to load material into the baling chamber for compression.

11. The baling assembly of claim 10, further comprising a storage container and a dumping mechanism configured to lift the storage container and transfer material from the storage container into the hopper.

12. The baling assembly of claim 1, wherein the light source is positioned along one of a sidewall, an upper surface of the housing, or a top frame member of the housing.

13. The baling assembly of claim 12, wherein the light source is positioned adjacent the transparent access panel.

14. The baling assembly of claim 1, wherein the light source comprises multiple light-emitting diodes arranged in a strip and mounted to one of a sidewall, an upper surface of the housing, or a top frame member of the housing.

15. A baling assembly, comprising:

a housing defining an interior;

a baling chamber within the housing;

a gathering ram chamber within the housing adjacent the baling chamber and extending from the baling chamber along a first direction, the gathering ram chamber comprising a first movable wall and a first driving mechanism operably coupled to the first movable wall for compression of material within the baling chamber;

an ejection ram chamber within the housing adjacent the baling chamber and extending from the baling chamber along a second direction, the ejection ram chamber comprising a second movable wall and a second driving mechanism operably coupled to the second movable wall for ejection of compressed material from the baling chamber;

a first transparent access panel located at a distal end of the gathering ram chamber and a second transparent access panel located at a distal end of the ejection ram chamber, wherein a portion of the interior is viewable from outside the housing through the first transparent access panel and through the second transparent access panel;

a first light source within the housing adjacent the first transparent access panel; and a second light source within the housing adjacent the second transparent access panel.

16. The baling assembly of claim 15, wherein at least one of the first transparent access panel or the second transparent access panel comprises at least one of glass, acrylic, or a polycarbonate material.

17. The baling assembly of claim 15, wherein at least one of the first transparent access panel or the second transparent access panel comprises a rotatable door.

18. The baling assembly of claim 15, wherein at least one of the first light source or the second light source comprises a plurality of light-emitting diodes arranged in a strip.

19. The baling assembly of claim 15, wherein at least one of the first light source or the second light source is positioned along one of a sidewall, an upper surface of the housing, or a top frame member of the housing.

* * * * *